United States Patent [19]

Magidson

[11] 4,411,025

[45] Oct. 25, 1983

[54] COMBINED CHEST PIECE AND SHOULDER PAD

[75] Inventor: Mark Magidson, Los Angeles, Calif.

[73] Assignee: Moldex/Metric Products, Inc., Culver City, Calif.

[21] Appl. No.: 452,217

[22] Filed: Dec. 22, 1982

[51] Int. Cl.[3] ..... A41D 1/00; A41D 27/26; A41D 27/02

[52] U.S. Cl. ..... 2/97; 2/268; 2/272

[58] Field of Search ..... 2/268, 267, 97, 44, 2/45, 272, 255

[56] References Cited

U.S. PATENT DOCUMENTS 2,509,645 5/1950 Kleinrock ..... 2/268

2,579,894 12/1951 Yaghubian ..... 2/268

*Primary Examiner*—Doris L. Troutman

*Attorney, Agent, or Firm*—Charles H. Schwartz; Ellsworth R. Roston

[57] ABSTRACT

A combined chest piece and shoulder pad, comprising an integral unitary structure formed of molded non-woven fiber material including a chest piece portion having a shape to form a foundation for the chest area of a jacket and with the chest piece portion having a central area surrounded by peripheral edge portions and with the peripheral edge portions more tightly compacted than the central area to provide for a tapering between the central area and the peripheral edge portions and with the central area compacted sufficiently to provide for a firm support of the jacket in the chest area, and a shoulder pad portion having a shape to form a foundation for the shoulder portion of the jacket and with the shoulder pad portion having an inner edge and an outer edge and with a portion of the inner edge contiguous with a peripheral edge portion of the chest piece portion and with the inner edge more tightly compacted than the remaining portion of the shoulder pad portion and with the remaining portion of the shoulder pad portion tapering from the more tightly compacted inner edge to the outer edge which is less tightly compacted than the chest piece portion to form a lightly compacted shoulder pad to provide for a soft resilient support of the jacket in the shoulder area.

14 Claims, 8 Drawing Figures

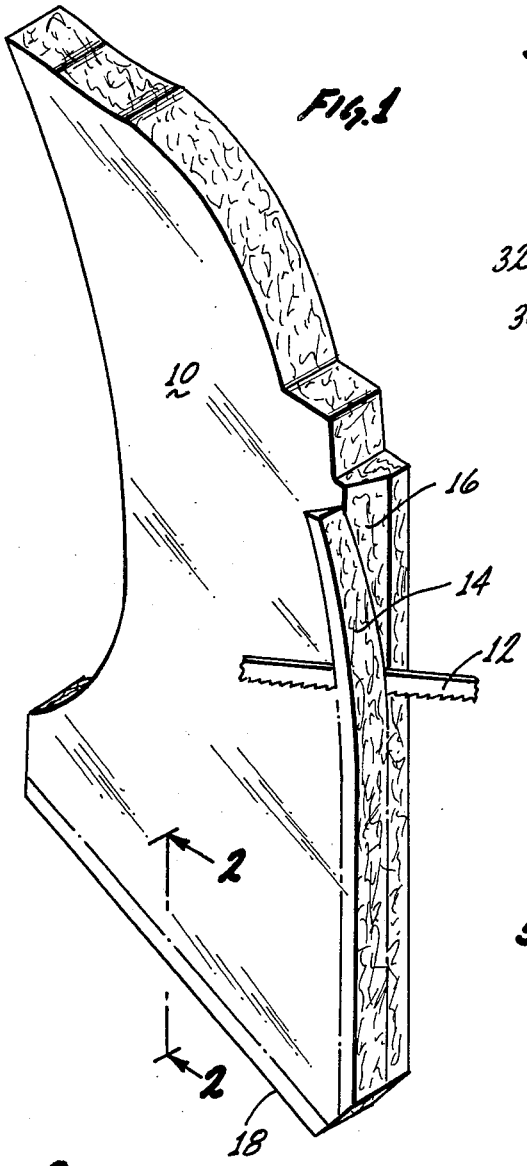
Fig. 1
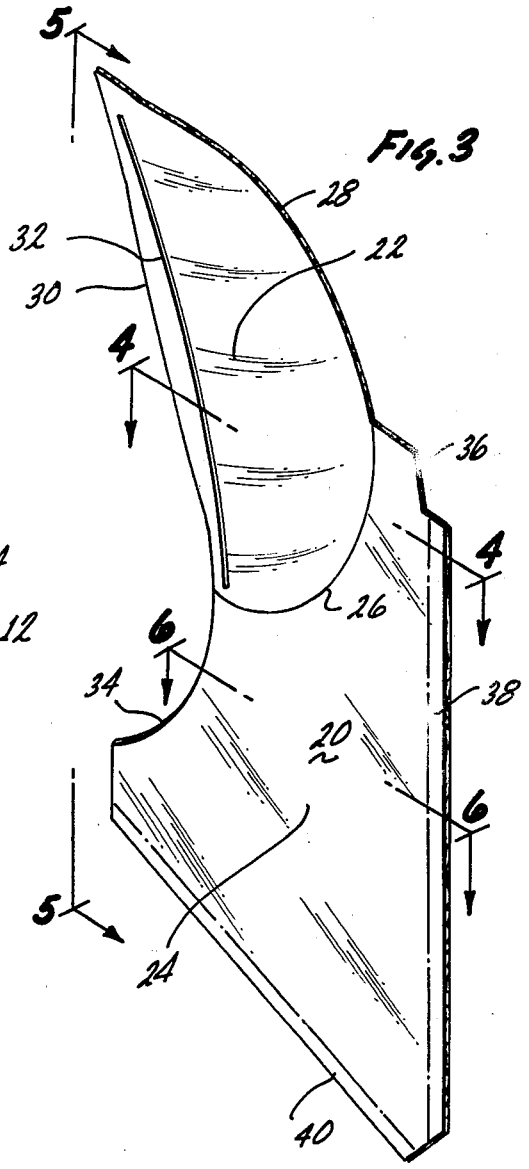
Fig. 3
Fig. 2
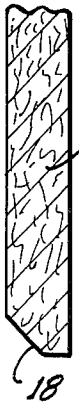
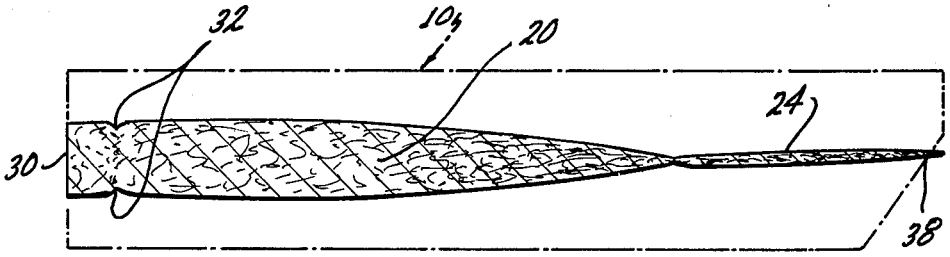
Fig. 4

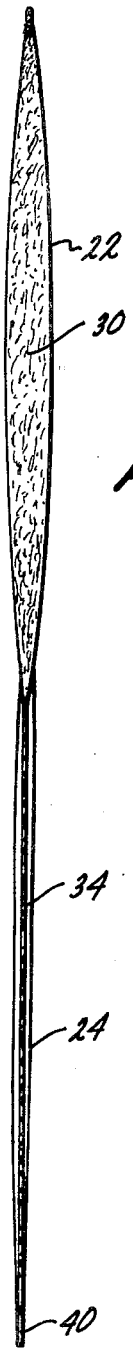
FIG. 5
FIG. 6
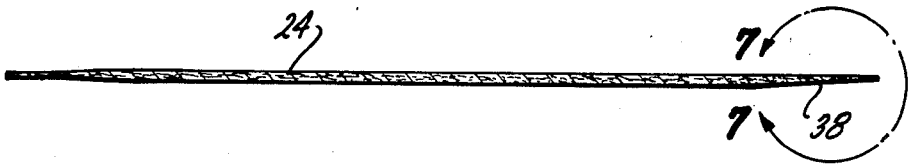
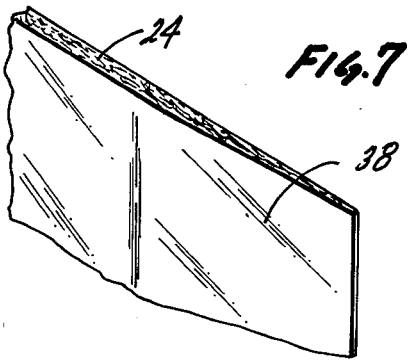
FIG. 7
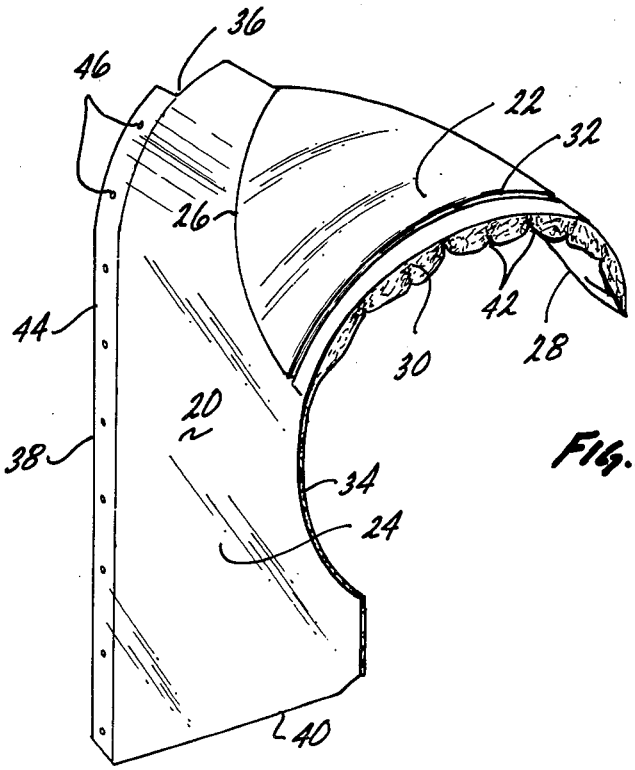
FIG. 8

COMBINED CHEST PIECE AND SHOULDER PAD

BACKGROUND OF THE INVENTION

1. Field of the Invention

The present invention is directed to a combined chest piece and shoulder pad of a unitary construction formed of molded non-woven fiber.

2. Description of the Prior Art

In general suit jackets or sport jackets are constructed with separate chest pieces and shoulder pads. These separate chest pieces and shoulder pads are generally constructed of a plurality of layers of material including stiffer layers and softer layers such as a canvas layer for support and with felt and/or cotton layers to provide for a smooth soft foundation for the outer cloth of the garment. The various layers of material are generally stitched together and must be carefully fitted within the garment in order to provide for a proper foundation for the garment.

There has been at least one prior art attempt to simplify the above described structure by the use of a unitary foundation as described in Yaghubian U.S. Pat. No. 2,579,894 issued Dec. 25, 1951. This patent shows a multi layer structure providing for a foundation front for garments which does provide for a unitary chest piece and shoulder pad being formed from a plurality of layers of material stitched together. However, the Yaghubian patent does not address the problem of a simple one piece unitary combined chest piece and shoulder pad which would be simpler and less expensive than the prior art structures.

SUMMARY OF THE INVENTION

The present invention provides for a unitary combined chest piece and shoulder pad constructed of molded non-woven fiber. The combined chest piece and shoulder pad of the present invention is labor saving in that it eliminates the necessity of the separate positioning of the shoulder pad and the chest piece. The construction of the present invention also eliminates the now common practice of making up the chest piece from a number of separate elements. In addition, the combined chest piece and shoulder pad is pre-cut to include the proper shape for the chest piece as it goes under the arm and also includes the proper shape for the lapel break where the collar is attached to the jacket. Since the combined chest piece and shoulder pad is molded of non-woven fiber material, this construction is both washable and dry cleanable and can be used with any outer fabric for the jacket.

The combined chest piece and shoulder pad of the present invention is also universal in that it can be used for either the right or left side of the jacket. In addition, the shoulder pad portion presents a smooth outer surface for the fabric even though an inner surface of the shoulder pad portion may have ridges to relieve compression caused by the curving of the shoulder pad portion. Because the combined chest piece and shoulder pad is molded, it can be molded to be stiff where necessary and to be flexible where necessary and to have soft resilient padded portions were necessary. The overall structure feels natural to the wearer of the jacket and provides for a comfortable fit of the jacket. In order to provide for the proper tapering at the edges of the combined chest piece and shoulder pad, the non-woven fiber may be cut away prior to molding to produce an even more tapered and flexible edge portion for blending with the jacket fabric.

As an additional adjunct to the present invention a separate tape member may be attached along the edge of particular portions of the combined chest piece and shoulder pad. The tape may include adhesive for attaching the particular edge portions to the inner surface of the outer fabric from which the jacket is fashioned. In addition, the structure of the present invention lends itself to direct stabilization wherein either a coating of resin or rows of resin are applied to the inner surface of the fabric from which the jacket is fashioned, and with this resin acting as an adhesive to bind the combined chest piece and shoulder pad to the outer fabric.

BRIEF DESCRIPTION OF THE DRAWINGS

A clearer understanding of the invention will be had with reference to the following description and drawings wherein FIG. 1 is a perspective view of a pre-cut sheet of non-woven fiber material prior to molding.

FIG. 2 is a cross section of the non-woven fiber material taken along lines 2—2 of FIG. 1.

FIG. 3 is a perspective view of a combined chest piece and shoulder pad of the present invention after molding.

FIG. 4 is a cross section of the combined chest piece and shoulder pad taken along lines 4—4 of FIG. 3.

FIG. 5 is an end view of the combined chest piece and shoulder pad taken along lines 5—5 of FIG. 3.

FIG. 6 is a cross section of the combined chest piece and shoulder pad taken along lines 6—6 of FIG. 3.

FIG. 7 is fragmentary view of the combined chest piece and shoulder pad of the portion 7—7 of FIG. 6.

FIG. 8 is the combined chest piece and shoulder pad of FIG. 3 as shaped for use in providing a foundation for a jacket.

DESCRIPTION OF THE PREFERRED EMBODIMENT

FIG. 1 illustrates a pre-cut sheet of very lightly compacted non-woven fiber material. The fiber material may be any of the known types of fiber generally used for molding and as an example fifteen (15) denier polyester fiber coated with an acrylic resin may be used. When molded under heat and pressure in a particular mold form, this material will conform to the desired shape and thickness to produce the structure of the present invention. As can be seen in FIG. 1, the pre-cut sheet has numerous cut outs which, after molding, will conform to pre-selected foundation areas when used for providing for the combined chest piece and shoulder pad of the present invention.

Prior to molding the pre-cut sheet 10, various edge portions may be cut away as shown by saw blade 12 cutting away excess material 14 to provide for a tapered edge 16. As illustrated in FIG. 2, a bottom edge 18 of the sheet 10 may also be cut away prior to molding. Cutting away the excess material such as excess material 14, allows for these edge portions to taper to a very fine edge but also allow for this fine edge to be flexible and blend with the outside fabric of the jacket.

FIG. 3 illustrates a combined chest piece and shoulder pad of 20 of the present invention which is produced by molding the pre-cut sheet 10 shown in FIG. 1. The actual mold members are not shown but it is to be appreciated that these mold members have an inside configuration conforming to the outside configuration of the combined chest piece and shoulder pad 20 as shown in FIGS. 3 through 8.

The combined chest piece and shoulder pad structure 20 includes a number of integrally molded areas to provide for a variety of separate functions. The structure 20 includes a shoulder pad portion 22 and a chest piece portion 24. The shoulder pad portion 22 provides an increasing taper from an inner edge 28 to an outer edge 30. The inner edge 28 is partially contiguous with a curved line 26 which is a dividing line between the shoulder pad portion 22 and the chest piece portion 24. The inner edge 28 of the shoulder pad portion 22 is very tightly compacted and with the amount of compaction decreasing across the shoulder pad portion to have the outer edge 30 lightly compacted. As shown in FIGS. 3, 4 and 5, the shoulder pad portion 22 therefore provides for a softly padded outside portion which tapers down into a more tightly compacted inner portion to provide for the proper shape and configuration to support the fabric of the jacket in the shoulder area.

The shoulder pad portion 22 also includes lightly compressed lines 32 which lie on opposite sides of the shoulder pad portion 22 adjacent the edge portion 30. These lightly compressed lines 32 act as a guide during the making of the jacket and guides the tailor to provide stitching along the lines 32.

The chest piece portion 24 includes a central area which is generally tightly compacted when compared with the shoulder pad portion 22. Surrounding the central area of the chest piece portion are peripheral edge portions which are more tightly compacted than the central area as shown in FIGS. 3 through 8. This allows the chest piece portion to be thin and flexible to suport the outer fabric.

The chest piece portion 24 includes a number of cut outs so that the combined chest piece and shoulder pad of the present invention properly serves as a foundation for the chest and shoulder of the jacket. In particular, the chest piece portion 24 includes an arm hole cut out 34 and a lapel break cut out 36. This allows the chest piece portion to properly fit under the arm hole of the jacket and to properly accommodate the attachment of the collar to the jacket. As can be seen in FIGS. 1 and 2, edge portions of the initial pre-cut sheet may be cut away on an angle so that the resultant edge portions 38 and 40 taper to a very fine edge while still retaining a high degree of flexibility. This allows the edge portions 38 and 40 of the chest piece portion 24 to blend and not be noticeable underneath the fabric along the jacket opening and across the front of the jacket in the waist area. The edges of the chest piece portion 24 along the cut out areas of the arm hole 34 and the lapel cut out 36 are stiffer than the edge portions 38 and 40, since these edges are not cut away prior to molding, but it is to be appreciated that if desired these portions could also be cut away.

FIG. 8 illustrates the combined chest piece and shoulder pad 20 of the present invention positioned to be fitted within a jacket so as to provide for a foundation for the shoulder by the shoulder pad portion 22 and a foundation for the chest by the chest piece portion 24. The combined chest piece and shoulder pad 20 of the present invention is universal in that it can be used for either the right or left side of the jacket depending upon the direction of curvature. In FIG. 8, the combined structure 20 is shown to provide a foundation for the left side of the jacket. As can be seen in FIG. 8, that when the shoulder pad portion 22 is bent in an arcuate configuration, the inner surface of the shoulder pad portion 22 forms a series of inner ridges 42. These inner ridges relieve the stress in the shoulder pad portion 22 and tend to pull the outer surface into a smooth arcuate configuration to produce a smooth foundation for the fabric of the jacket. The outer surface of the shoulder pad portion 22 is therefore in slight tension, while the inner surface is in slight compression which compression produces the ridges 42.

As an adjunct to the present invention, an adhesive tape member 44 may be attached along the edge 38 in the chest piece portion 24. The tape may be attached by adhesive or may be spot welded as shown the series of dots 46 located along the length of the tape. The adhesive tape 44 may then be used to directly bond the edge 38 of the combined chest piece and shoulder pad 20 of the present invention to the inner surface of the outer fabric by any appropriate means. For example, the tape 44 may include a heat sensitive adhesive so that pressing the outer fabric produces the adhesion of the tape 44.

The structure of the present invention may also be used in jacket constructions which include direct stabilization wherein a coating of a resin such as an acrylic resin is included on the inner surface of the fabric which is to be fashioned into the jacket. This resin may either cover the entire inner surface or may be formed as rows. When heat is applied the inner surface of the material will thereby adhere to the combined chest piece and shoulder pad of the present invention thereby stabilizing the fabric during construction.

The present invention therefore is directed to a combined structure which is labor saving in that it eliminates a number of individual steps present with prior art devices and provides for this elimination with a structure which is simpler than any of the prior art devices. The structure of the present invention may be used with any type of fabric and the non-woven fiber used to form the combined structure is both washable and dry cleanable. The resultant combined structure is soft and resilient in the places where such softness and resiliency is desired and therefore feels natural to the wearer of the garment. In addition, by proper molding the combined structure may be stiff where necessary and flexible where necessary. Additional inserts such as the use of an additional tape member may be used if desired.

Although the invention has been described with reference to a particular embodiment, it is to be appreciated that various adaptations and modifications may be made and the invention is only to be limited by the appended claims.

I claim:

1. A combined chest piece and shoulder pad, comprising an integral unitary structure formed of molded non-woven fiber material including a chest piece portion having a shape to form a foundation for the chest area of a jacket and with the chest piece portion having a central area surrounded by peripheral edge portions and with the peripheral edge portions more tightly compacted than the central area to provide for a tapering between the central area and the peripheral edge portions and with the central area compacted sufficiently to provide for a firm support of the jacket in the chest area, and a shoulder pad portion having a shape to form a foundation for the shoulder portion of the jacket and with the shoulder pad portion having an inner edge and an outer edge and with a portion of the inner edge contiguous with a peripheral edge portion of the chest piece portion and with the inner edge more tightly compacted than the remaining portion of the shoulder pad portion and with the remaining portion of the shoulder pad portion tapering from the more tightly compacted inner edge to the outer edge which is less tightly compacted than the chest piece portion to form a lightly compacted shoulder pad to provide for a soft resilient support of the jacket in the shoulder area.

2. The combined chest piece and shoulder pad of claim 1 wherein the chest piece portion includes cut-outs to accommodate the arm hole and label break of the jacket.

3. The combined chest piece and shoulder pad of claim 1 wherein the peripheral edge portions are pre-cut in thickness to produce fine flexible peripheral edge portions after molding.

4. The combined chest piece and shoulder pad of claim 1 wherein the pre-cut peripheral edge portions are along portions corresponding to the jacket opening and along the bottom edge.

5. The combined chest piece and shoulder pad of claim 1 additionally including lightly compacted lines on either side of the shoulder pad portion and extending along and adjacent to the outer edge.

6. The combined chest piece and shoulder pad of claim 1 additionally including adhesive tape extending along peripheral edge portions corresponding to the jacket opening.

7. The combined chest piece and shoulder pad of claim 1 wherein the non-woven fiber is polyester fiber of approximately 15 denier.

8. A combined chest piece and shoulder pad for use as a foundation for a jacket comprising an integral unitary structure formed of molded non-woven fiber material including portions having different levels of compaction and with a chest piece portion forming a firm foundation for the chest area of the jacket and with the chest piece portion having a central area having a first level of compaction and surrounded by peripheral edge portions having a second higher level of compaction to provide for a tapering between the central area and the peripheral edge portions and a shoulder pad portion forming a soft resilient foundation for the shoulder area of the jacket and with the shoulder pad portion having an inner edge and an outer edge and with a portion of the inner edge contiguous with a peripheral edge portion of the chest piece portion and with the inner edge having substantially the second higher level of compaction and with the remaining portion of the shoulder pad portion tapering from the higher second level of compaction at the inner edge to a third lower level of compaction at the outer edge and with the third lower level of compaction less than the first level of compaction.

9. The combined chest piece and shoulder pad of claim 8 wherein the chest piece portion includes cut-outs to accomodate the arm hole and label break of the jacket.

10. The combined chest piece and shoulder pad of claim 8 wherein peripheral edge portions are pre-cut in thickness to produce fine flexible peripheral edge portions after molding.

11. The combined chest piece and shoulder pad of claim 10 wherein the pre-cut peripheral edge portions are along portions corresponding to the jacket opening and along the bottom edge.

12. The combined chest piece and shoulder pad of claim 8 additionally including lightly compacted lines on either side of the shoulder pad portion and extending along and adjacent to the outer edge.

13. The combined chest piece and shoulder pad of claim 8 additionally including an adhesive tape extending along peripheral edge portions corresponding to the jacket opening.

14. The combined chest piece and shoulder pad of claim 8 wherein the non-woven fiber is polyester fiber of approximately 15 denier.

* * * * *